United States Patent [19]

Salo

[11] Patent Number: 4,863,404

[45] Date of Patent: Sep. 5, 1989

[54] JET PROPULSION AND STABILIZATION MEANS FOR SHIPS

[76] Inventor: Eric A. Salo, 15898 Via Pinale, San Lorenzo, Calif. 94580

[21] Appl. No.: 205,860

[22] Filed: Jun. 13, 1988

Related U.S. Application Data

[63] Continuation of Ser. No. 450,565, Dec. 16, 1982, abandoned.

[51] Int. Cl.[4] ..... B63H 11/00

[52] U.S. Cl. ..... 440/38; 440/43; 440/89; 114/122; 114/151

[58] Field of Search ..... 440/38, 39, 40, 41, 440/42, 43, 44, 45, 47, 68, 89; 114/121, 122, 150, 151, 147, 126, 148; 60/221, 222

[56] References Cited

U.S. PATENT DOCUMENTS

| | | | |
|---|---|---|---|
| 1,843,574 | 2/1932 | May | 440/40 |
| 2,231,296 | 2/1941 | Sartori | 440/38 |
| 2,636,467 | 4/1953 | Johnson | 440/38 |
| 3,155,065 | 11/1964 | Strumskis | 440/38 |
| 3,296,997 | 1/1967 | Hoiby et al. | 440/89 |
| 3,517,633 | 6/1970 | Wanzer | 114/151 |
| 3,601,989 | 8/1971 | Austin | 60/221 |
| 3,611,972 | 10/1971 | Duport | 114/151 |
| 3,677,215 | 7/1972 | Moss | 440/43 |
| 3,943,876 | 3/1976 | Kiekhaefer | 440/89 |
| 3,977,353 | 8/1976 | Toyama | 440/38 |
| 4,095,547 | 6/1978 | Benington | 114/126 |

*Primary Examiner*—Sherman D. Basinger
*Assistant Examiner*—Stephen P. Avila
*Attorney, Agent, or Firm*—Frank A. Neal

[57] ABSTRACT

A jet propulsion system is provided for ships. Port and starboard ductways are provided with radial constrictor axial-flow impellers, and the output flow therefrom is divided between hull-bottom and hull-side discharge outlets. A stabilizer system is provided comprising pivotal deflectors in the hull-side jet outlets and means to automatically control these deflectors responsive to both rate of roll and angle of roll to counteract rolling of the vessel.

2 Claims, 7 Drawing Sheets

JET PROPULSION AND STABILIZATION MEANS FOR SHIPS

This application is a continuation of application Ser. No. 450,565, filed Dec. 16, 1982, now abandoned for Jet Propulsion and Stabilization Means for Ships.

BACKGROUND OF THE INVENTION

1. Field of the Invention

The field of the invention is jet propulsion of ships and the utilization of jet water to reduce or eliminate primary bow waves, steer the ship, and control the roll attitude of the ship.

2. Description of the Prior Art

U.S. Pat. No. 3,977,353 discloses a water jet drive system for ships, the discharge ends of the jet tubes being located at the stern of the ship and being in axial alignment with the inlet ends of the jet tubes.

U.S. Pat. No. 3,601,989 discloses a jet propulsion system for boats in which the jet is driven by a two-stage pump impeller. The water intake is flush with the hull bottom. This means that the pump impeller must overcome suction at the intake which consumes about one-half of the work energy exerted by the pump impeller.

U.S. Pat. No. 3,155,065 shows a jet propulsion system for ships, including stabilizer or anti-roll means. Deflection water for stabilization is sucked inward into the hull. In my system the anti-roll effect is obtained by the control of deflectors within outboard rearwardly directed side jets. Also, in my system, the water for the side jets is moved through divergent curved paths between inboard inlets and outboard outlets in such a way as to impart anti-roll or stabilizing forces to the ship.

U.S. Pat. No. 2,636,467 discloses an hydraulic jet propulsion system for ships. The jet passageway contains a shrouded, extended propeller of a notably inefficient design. The jet passageway is provided with a cone-shaped constrictor section astern of the propeller. In my system the constrictor and impeller sections are combined by mounting axial-flow low-loss impeller blades within driven constrictor shrouds.

Other patents of general interest are the following:

| | |
|---|---|
| 4,051,801 | 3,276,415 |
| 4,031,844 | 3,266,733 |
| 3,969,891 | 3,155,071 |
| 3,930,367 | 3,137,265 |
| 3,826,218 | 3,114,239 |
| 3,782,320 | 3,105,353 |
| 3,589,325 | 3,082,732 |
| 3,482,402 | 2,832,305 |
| 3,465,705 | 2,664,700 |
| 3,388,684 | 1,800,408 |
| 3,342,032 | 1,543,026 |

SUMMARY OF THE INVENTION

The present invention provides ships with an efficient method and means of propulsion by accelerating the flow of water ingested from submerged intake ports at the bow of the ship and discharged toward the stern from ship-side and ship-bottom hydraulic jets. The reactive force of accelerating the water flow is transferred to the hull by thrust bearings and converted to kinetic energy of movement of the ship in the forward direction.

Adjustable deflectors are provided in the discharge ducts of the propulsion jets at each side of the ship and means are provided to controllably adjust these deflectors. The deflectors are controlled to give upward and downward reactive forces to counteract the rolling action of the ship. Anti-roll control is provided by a pendulum system which senses both the degree of roll and the rate of roll. The rate of roll function is made primary in the control of the side jet deflectors in order to initiate anti-roll control at the instant when rolling starts, providing maximum operating time for control action.

Axial-flow propulsion pumps provide hydraulic flow with minimal dynamic losses is the system. The pump impellers consist of low-loss impeller blades mounted in a driving constrictor shroud which is rotationally driven by a link and roller drive chain which engages a ring sprocket fastened to the outer periphery of the shroud. Labyrinth-type hydraulic seals are installed on water inlet and outlet ends of the pumps and matched to sealing strips affixed to the inlet and outlet ends of the pump shrouds.

DESCRIPTION OF THE PREFERRED EMBODIMENTS

Figure 2:
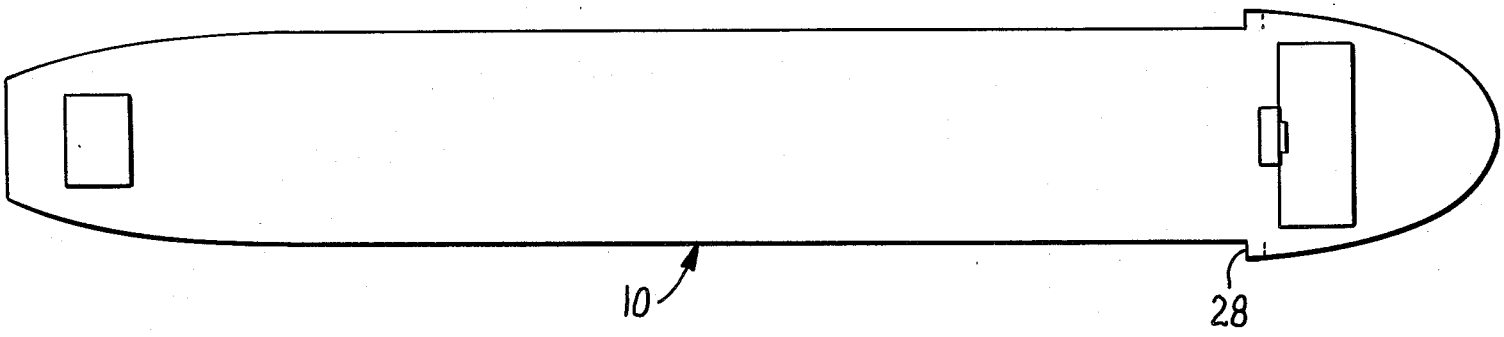
FIG. 2 is a top plan view of said ship.
Figure 1:
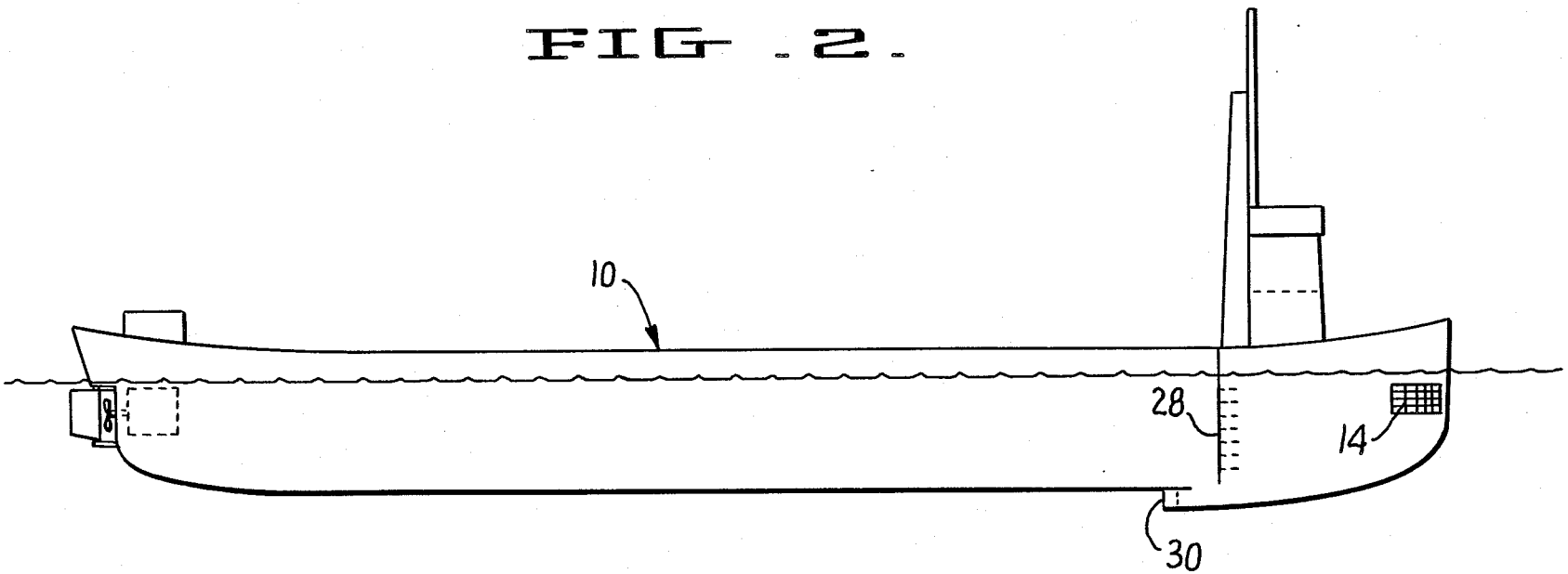
FIG. 1 is a view in side elevation of a ship embodying the invention.
Figure 3:
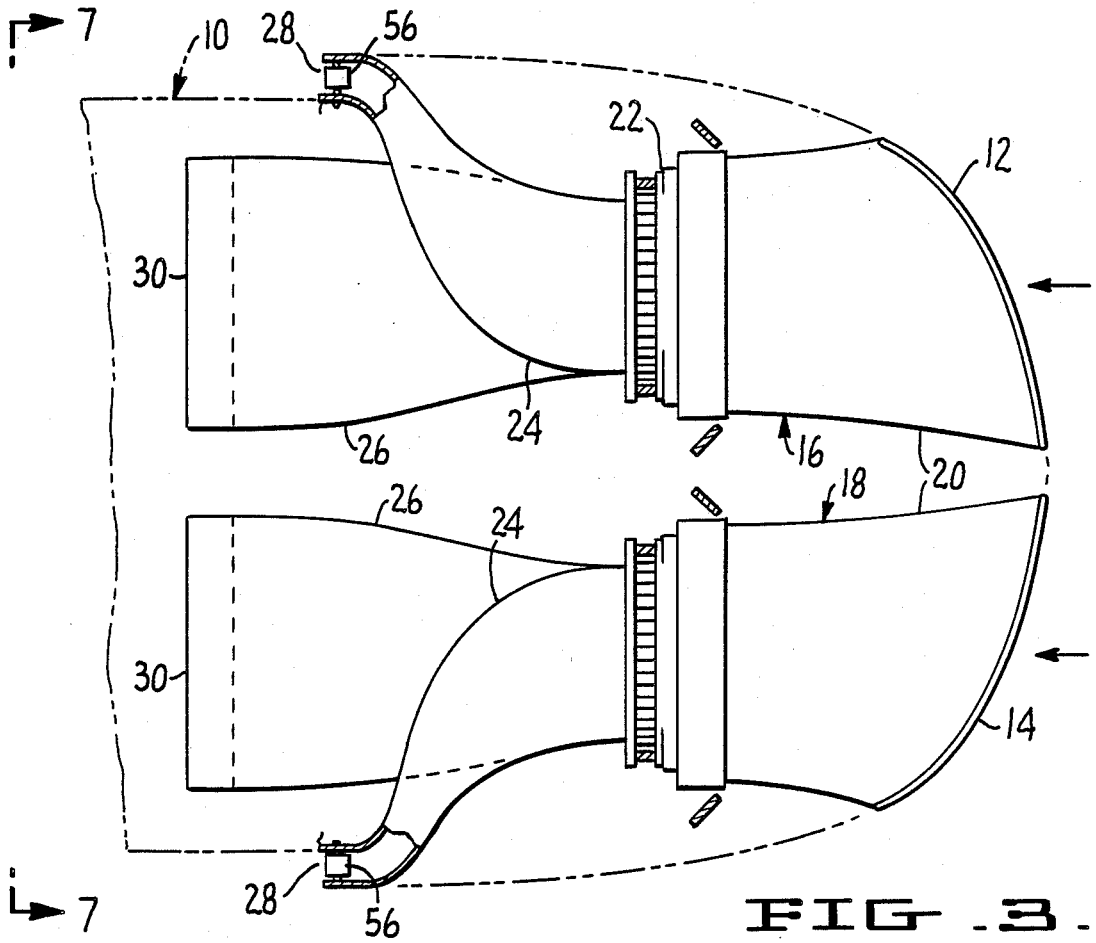
FIG. 3 is a semi-schematic layout view which shows essentially in plan view orientation the jet propulsion system of the invention.
Figure 4:
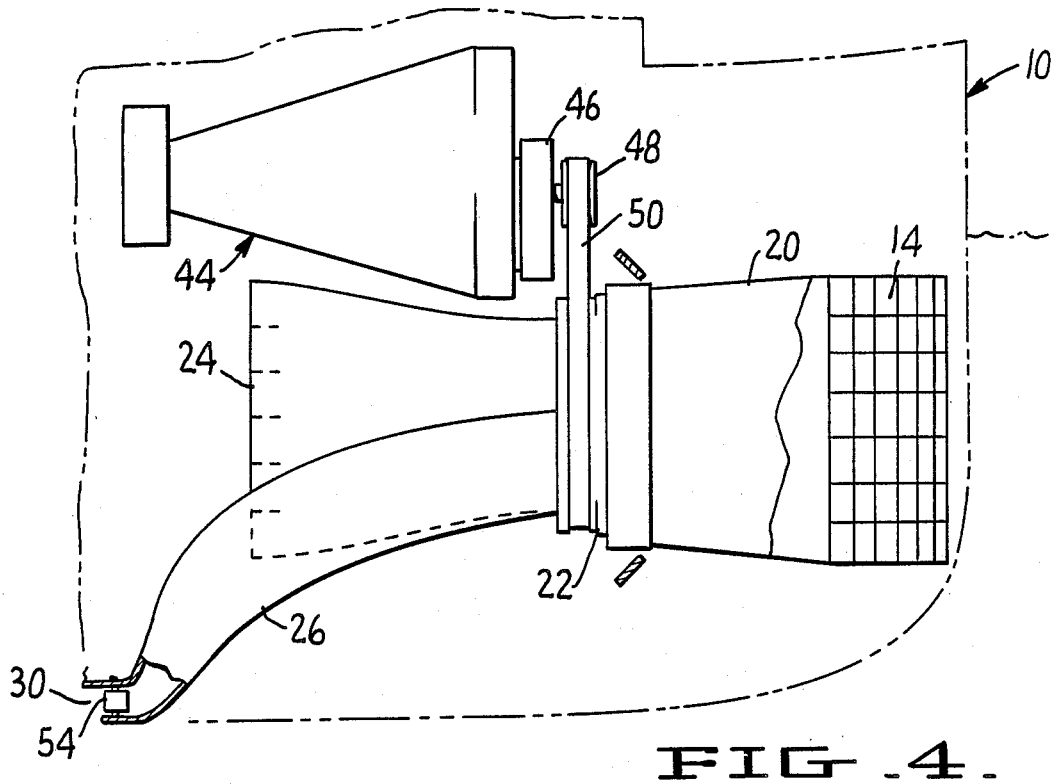
FIG. 4 is a semi-schematic view showing essentially in side elevation orientation the jet propulsion system of the invention.
Figure 5:
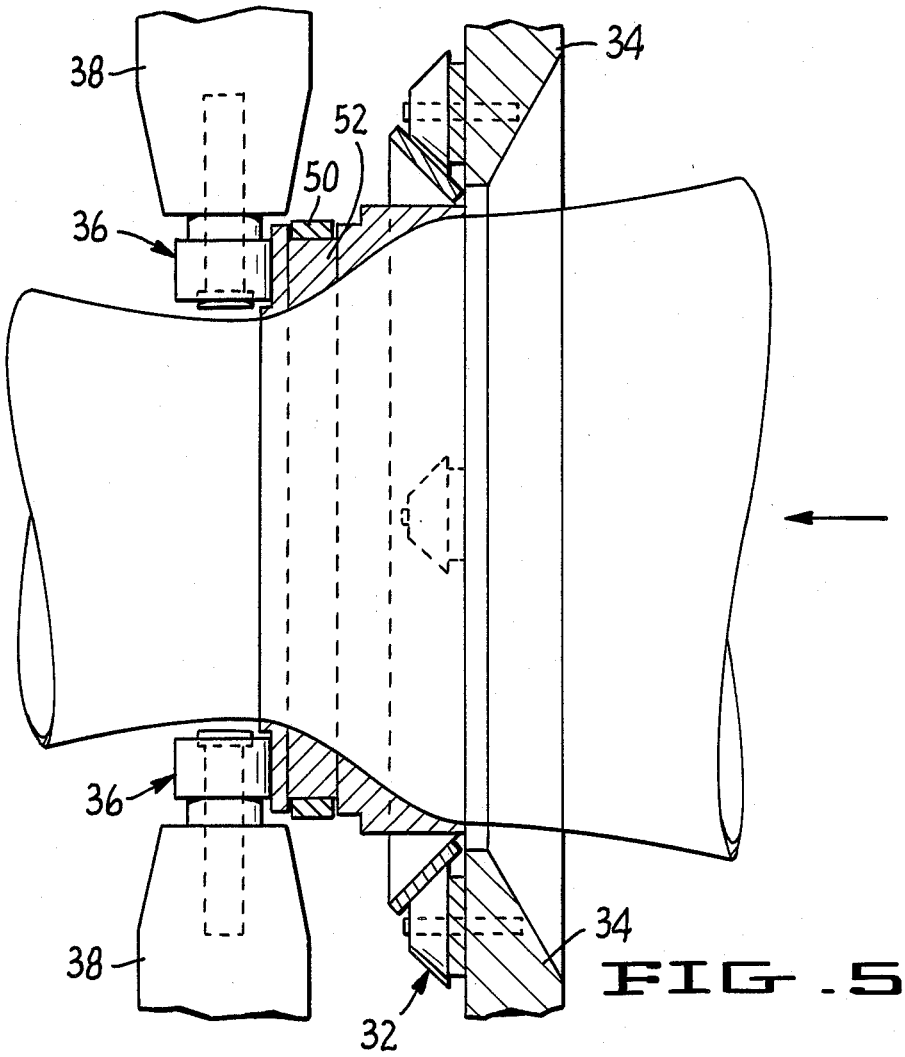
FIG. 5 is an enlarged detail view, partly in diametral cross-section, of the pump impeller drive and bearing systems.

(1) Jet Propulsion System Method and Means

Ship 10 is provided with a pair of screen-covered propulsion water inlets 12, 14 providing communication with ducts 16, 18. These ducts comprise intake portions 20, impeller housings 22, upper water ducts 24, and lower water ducts 26. Ducts 24 are curved outwardly and rearwardly and provide communication between the impeller housings 22 and outboard side jet nozzles 28. Ducts 26 are curved downwardly and rearwardly and provide communication between the impeller housings and outboard bottom jet nozzles 30.

As shown in FIGS. 1–4 of the drawings, the outboard side and bottom nozzles 28, 30 are rearwardly directed and are disposed immediately laterally adjacent hull 10, that is, they are directed along paths which are laterally adjacent those portions of hull 10 which extend sternwards of said nozzles, said nozzles being operable to emit therefrom into seaway voids, set up by movement of said hull and nozzles through the seaway at the normal forward velocity of the hull, discharges of water which are parallel to each other and parallel to the longitudinal axis and the direction of normal, or translational, movement of the hull and which have a rearward velocity relative to the hull substantially corresponding to the normal forward velocity of the hull.

The impeller housings 22 comprise shrouds of radial constrictor form mounted for rotation by anti-friction thrust bearing means 32 attached to structural support members 34 and anti-friction alignment bearing means 36 attached to structural support members 38.

Figure 6A:
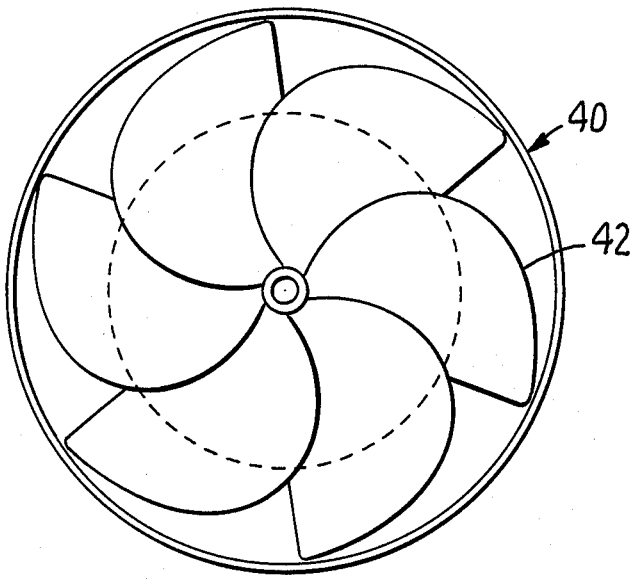
FIG. 6A is a view in front elevation of the pump impeller of the jet propulsion system.
Figure 6B:
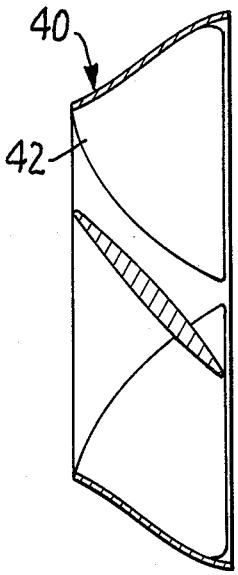
FIG. 6B is a view in side elevation of the impeller.
Figure 7:
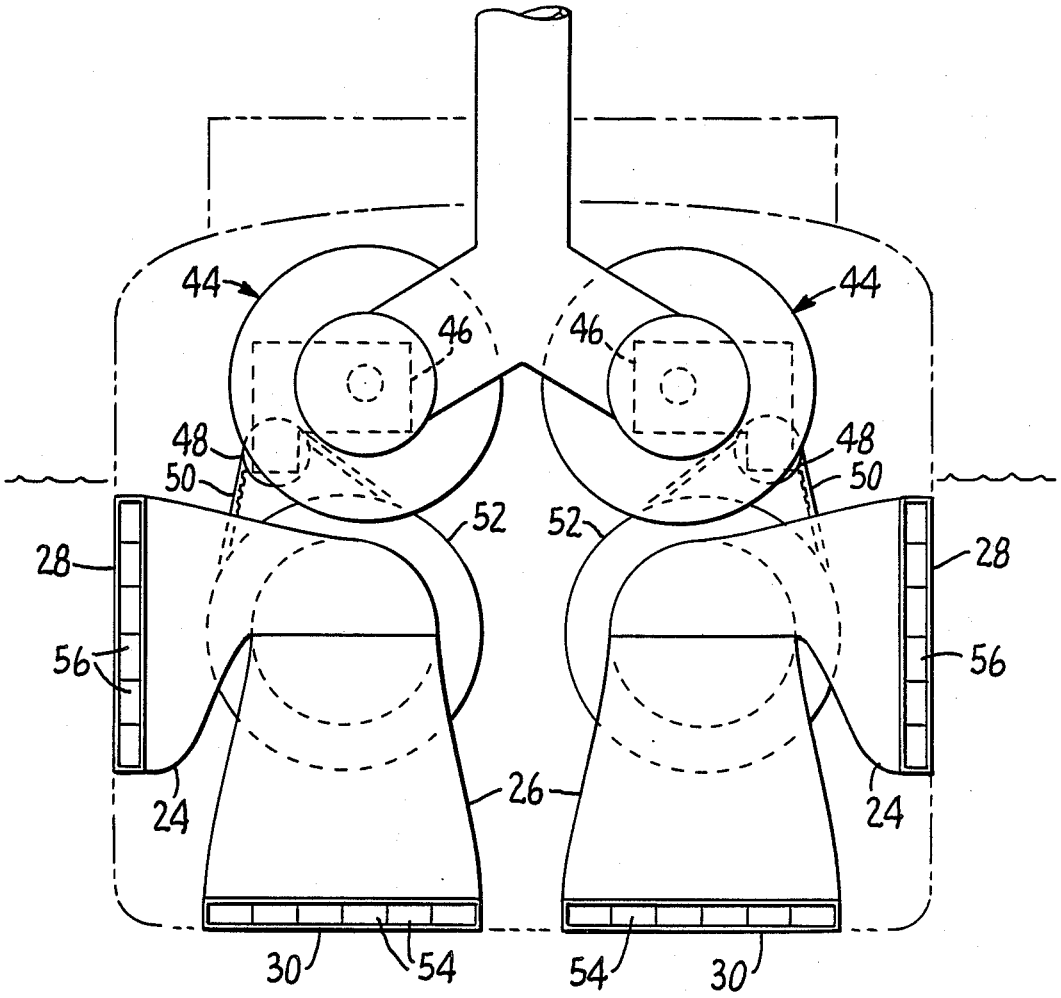
FIG. 7 is a semi-schematic view of the propulsion system, shown mainly as taken along lines 7—7 of FIG. 3.
Figure 8A:
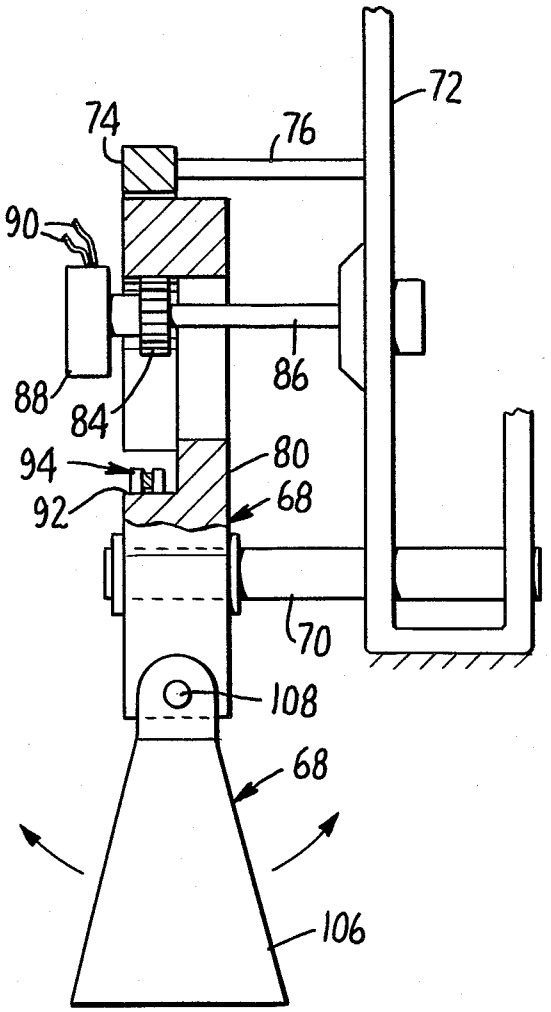
FIG. 8A is a semi-schematic view showing essentially in side elevation orientation the control elements of the anti-roll control system.
Figure 8B:
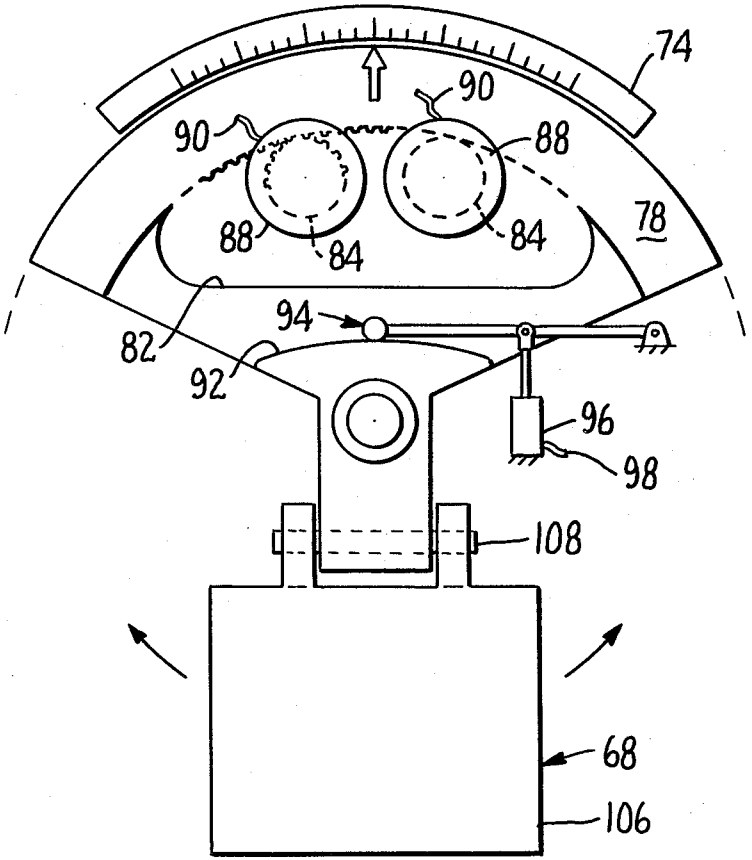
FIG. 8B is a view in front elevation of the control elements of FIG. 8A.
Figure 9:
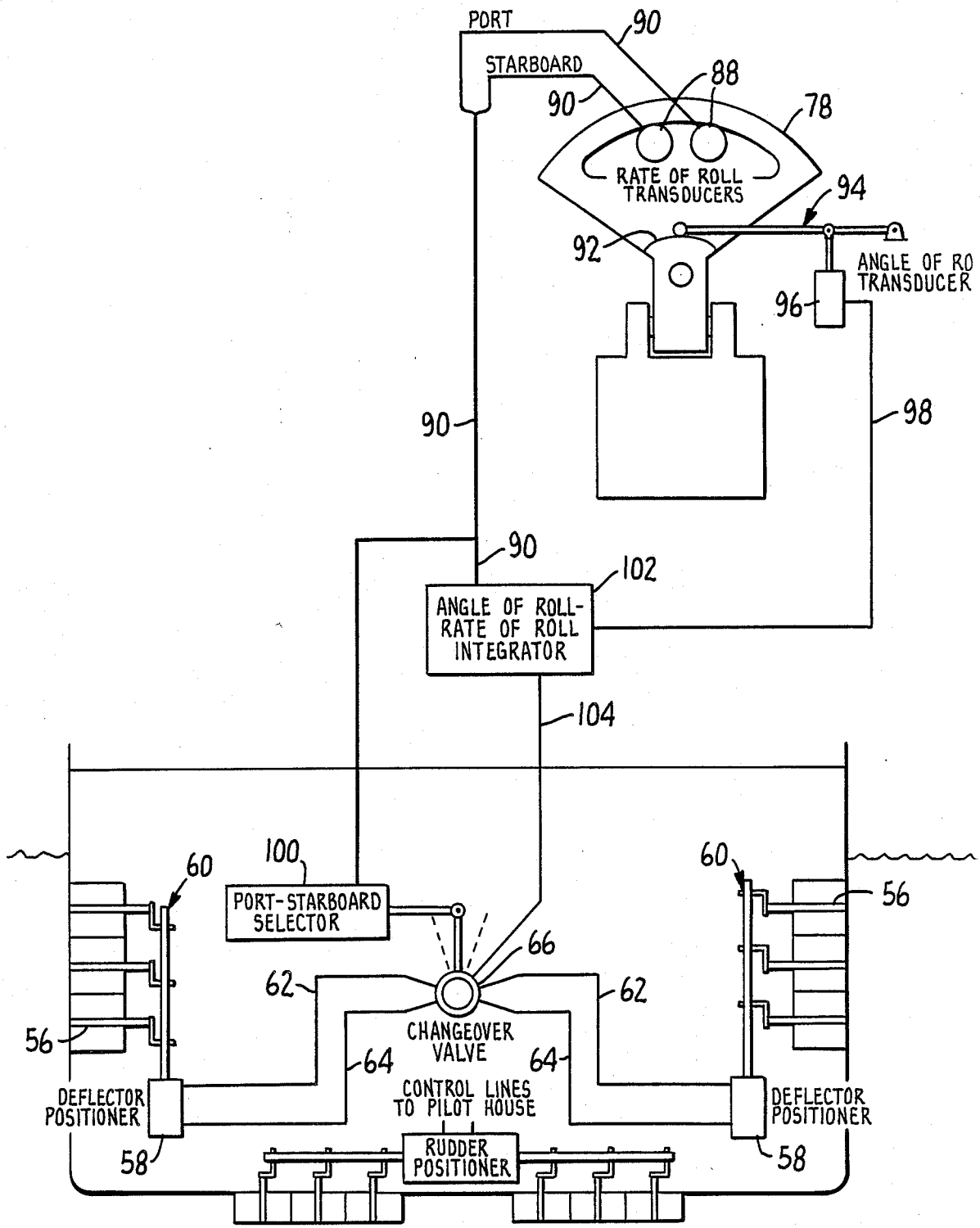
FIG. 9 is a schematic view showing together the antiroll control system and the stabilizer system controlled thereby.

Impellers 40 (FIGS. 6A and 6B) comprising blades 42 are fixedly secured to the rotatable housings or shrouds 22. These impellers constitute axial-flow propulsion pumps which provide hydraulic flow with minimal dynamic losses in the system.

Means for driving the impellers 40 comprise, for example, gas turbine prime movers 44, reduction gear means 46 driven thereby, driver sprockets 48 driven by the reduction gear means 46, and drive chains 50 interconnecting sprockets 48 and sprockets 52 formed on or attached to impeller shrouds 22.

The bottom jet nozzles 28 are provided with a plurality of bow rudder elements which are jointly pivotally movable about vertical axes by means 53 to steer the vessel.

The side jet nozzles are provided with deflector plate elements 56 mounted for pivotal movement about horizontal axes, under control of means hereinafter described, for the purpose of anti-roll stabilization of the vessel.

The jet drive system is operated to ingest at the bow of the ship an intake of water at a flow speed close to the full load speed of the ship in order to minimize the primary bow wave that would otherwise restrict the speed of the ship. The propulsion pumps or impellers accelerate the water flow to provide propulsion forces. The discharge ducts 24 and 26 from the impellers are shaped to function to reduce the water velocity without imposing reactive forces on the duct work that could counteract the forward reaction of the propulsion pumps. The design cross-sectional area of the side and bottom propulsion jets in total is such as to provide an average water jet flow outlet rate corresponding closely to the desired operating speed of the vessel. This insures that the jetted water has essentially zero hydrodynamic residual energy in respect to the water traversed by the vessel, thereby resulting in minimum loss and maximum hydrodynamic efficiency of propulsion.

Rolling of the ship under jet propulsion imposes centrifugal forces on the propulsion water as it flows outwardly and rearwardly from the axial pumps or impellers to the propulsion jets. These added centrifugal forces increase the hydrokinetic energy in the pumped water, contributing to the propulsive forces transmitted to the hull. This is believed to be a novel method for usefully utilizing part of the wave energy of the seaway.

(2) The Stabilization System

The stability of the ship is substantially enhanced by the use of the deflectors 56 in the side propulsion jets 28. The deflectors 56 are positioned by hydraulically powered actuators 58 through linkages 60 to pivot the deflectors about their horizontal pivot axes to provide upward or downward reactive forces to counteract rolling of the ship in a seaway. Roll to starboard is automatically opposed by depressing the starboard deflectors to impose an opposing moment to port, while at the same time the port deflectors are elevated to augment the moment to port. A roll to port is similarly opposed by reverse operation of the side jet deflectors 56.

Rolling of the vessels, i.e. rotation of the vessel about the longitudinal axis of vessel buoyancy, causes the jet propulsion duct work and the water contained therein to likewise rotate about the longitudinal axis of vessel buoyancy. The centrifugal forces thereby imparted to the large quantity of propulsion water within the duct work increases the hydrodynamic energy in the water, augmented by the positioning of the side jet deflectors. This additional hydraulic energy reduces the back-pressure of the discharge water on the propulsion pumps, increasing the jet energy or reducing the energy load on the pumps.

The positioners 58 are operated through hydraulic lines 62, 64 which in turn are under the control of a changeover valve 66 which is in turn under the control of the control system means now to be described.

The sensing element of the control system means is a pendulum 68 pivotally mounted on pin 70 attached to a permanent bulkhead structural member 72, pin 70 being positioned parallel to the fore-and-aft centerline of the vessel. This pivotal connection between the pendulum and the vessel permits the pendulum to remain stationary as rolling action of the vessel is initiated.

An arcuate calibration scale 74 is fixed to a permanent bulkhead member by support means 76, the scale 74 being in accurate register with a degree of roll sector 78 fixedly attached to the upper pendulum member 80. Roll sector 78 is slotted, as indicated by 82, and the upper arcuate surface of the slot is milled to provide gear teeth which are in engagement with roll rate gears 84 attached to spindles 86 which are carried for rotation by bulkhead 72 and operate roll rate transducers 88. Transducers 88 may comprise rotary vane air pumps vented to provide output air pressures through lines 90 which are proportional to the rate of roll as sensed by the pendulum systems. The rate of roll transducers 88 are driven by relative rotation of the roll sector 78 through ratchet mechanisms, not shown, so that starboard roll drives one of the transducer-blowers and roll to port drives the other. In control effect, the transducer pressure reflects both the direction of roll and the rate of roll.

Roll sector 78 is provided with an eccentric cam 92 which has associated therewith cam follower means 94, said means being in control relation to an angle of roll transducer 96. Transducer 96 reacts to provide a control air pressure through line 98 which is proportional at all times to the angle of roll of the vessel.

The control pressures in lines 90 function to operate a port-starboard selector 100. The rate of roll pressures in 90 and the angle of roll pressure in 98 are additively accumulated in an integrator means 102 to provide a sum output pressure in line 104 which, through the changeover valve 66 and the line 62, 64 controls the degree of operation of deflector positioner means 58.

Each of the positioners 58 has a "raise" pressure line 62 and a "lower" pressure line 64, the two positioners 58 being cross-connected to operate in reverse directions, i.e. when the port positioner is in a "raise" position, the starboard positioner is in a "lower" position. Changeover valve 66 operates as a switching control means for positioners 58.

The stabilizer system responds instantly to a change in the direction of roll of the vessel to operate the propulsion jets to oppose the roll as soon as the deflector positioners 58 respond to the control pressure. This provides for maximum possible duration of corrective function. The angle of roll also provides control pressure to deflector actuators in addition to the rate of roll control pressure to further enhance control effectiveness.

Lower pendulum portion 106 is free to swing about pivot pin 108 in response to fore-and-aft pitching motion of the vessel without disturbing the above-described control function of the pendulum.

(3) Combustion Product Injection

Figure 10B:
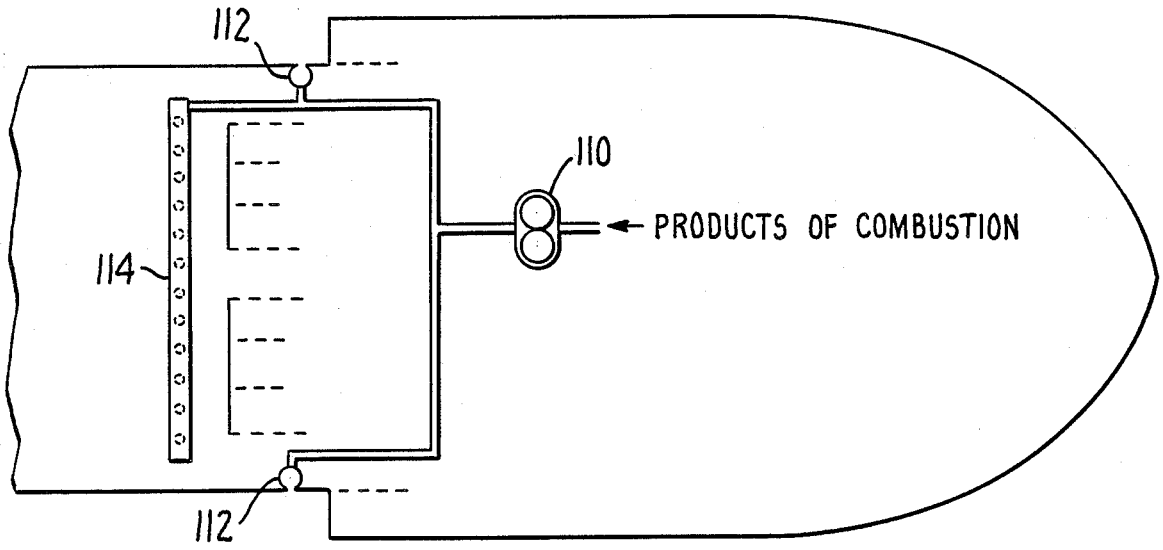
FIG. 10B is a semi-schematic view in top plan orientation of the system shown in FIG. 10A.
Figure 10A:
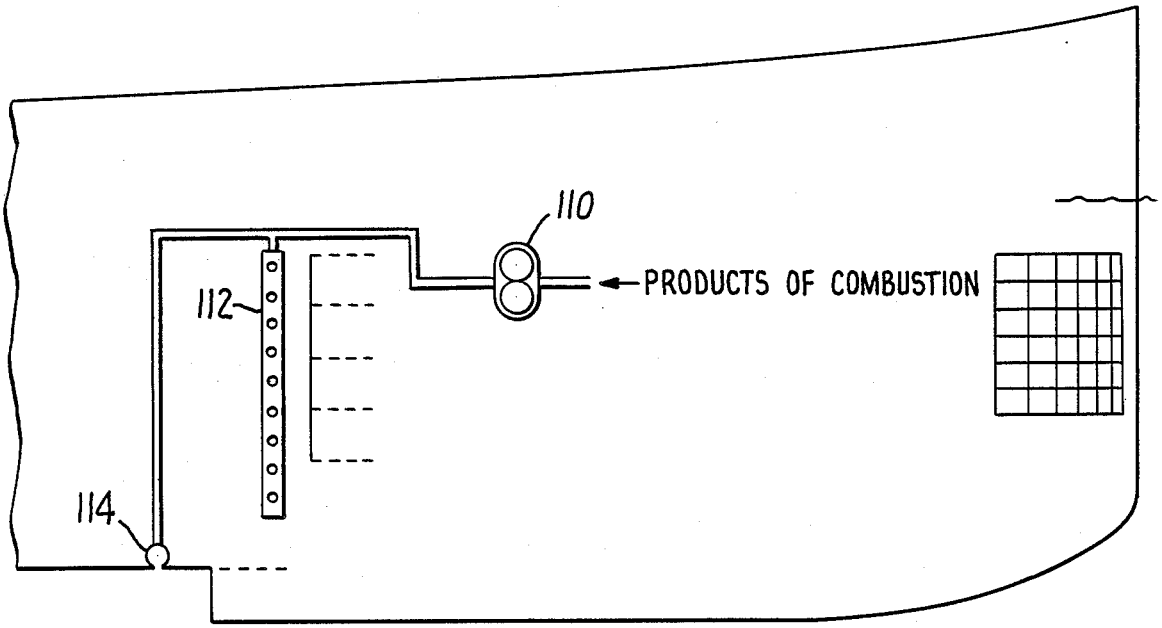
FIG. 10A is a semi-schematic view showing in side elevation orientation a system for injecting products of combustion into the hydraulic jets.

FIGS. 10A and 10B show a method of inhibiting marine growth on the outside of the ship's hull. Products of combustion from the turbines 44 and other power units on the ship are pressurized by pump 110 and injected through apertured headers 112, 114 positioned adjacent the side jet and bottom jet outlets to provide acidulated flows of water next to the hull's surface. The entrained gasses in the jet discharge water also provide for a volumetric compressibility of the water to reduce cavitational vibration on the hull.

What is claimed is:

1. In combination, a ship comprising a hull, frontally directed propulsion water intakes at the port and starboard sides of the bow, axial-flow radially constrictor pump impellers in axial flow communication with said intakes, said impellers being operable to discharge water at a velocity substantially in excess of the input velocity of water to said impellers, means to drive said impellers, alike duct receiving means in communication with the outlet sides of said impellers, said duct receiving means comprising longitudinally extending and downwardly curved ducts terminating in rearwardly directed bottom jet nozzles disposed at the outside of the bottom of the hull and immediately laterally adjacent thereto and laterally and outwardly curved ducts terminating in rearwardly directed side jet nozzles disposed at the outside of the sides of the hull and immediately laterally adjacent thereto, said bottom and side nozzles being operable to emit therefrom into seaway voids, set up by movement of said hull and nozzles through the seaway at the normal forward velocity of the hull, discharges of water which are parallel to each other and parallel to the longitudinal axis and the direction of translational movement of the hull and which have a velocity relative to the hull substantially corresponding to the normal forward velocity of the hull.

2. In combination, a ship comprising a hull, frontally directed propulsion water intakes at the port and starboard sides of the bow, axial-flow radially constrictor pump impellers in axial flow communication with said intakes, said impellers being operable to discharge water at a velocity substantially in excess of the input velocity of water to said impellers, means to drive said impellers, alike duct receiving means in communication with the outlet sides of said impellers comprising upper duct means and lower duct means, said upper duct means comprising laterally and outwardly curved ducts terminating in rearwardly directed side jet nozzles disposed at the outside of the sides of the hull and immediately laterally adjacent thereto, said upper duct means being operable to receive and transmit upper portions of the water discharge from said impellers, said lower duct means comprising longitudinally extending and downwardly curved ducts terminating in rearwardly directed bottom jet nozzles disposed at the outside of the bottom of the hull and immediately laterally adjacent thereto, said lower duct means being operable to receive and transmit lower portions of the water discharged from said impellers, said bottom and side nozzles being operable to emit therefrom into seaway voids, set up by movement of said hull and nozzles through the seaway at the normal forward velocity of the hull, discharges of water which are parallel to each other and parallel to the longitudinal axis and the direction of translational movement of the hull and which have a velocity relative to the hull substantially corresponding to the normal forward velocity of the hull.

* * * * *